US006899067B2

(12) United States Patent
Rosskamp et al.

(10) Patent No.: US 6,899,067 B2
(45) Date of Patent: May 31, 2005

(54) TWO-STROKE ENGINE AND METHOD OF OPERATING THE SAME

(75) Inventors: Heiko Rosskamp, Adelberg (DE); Christian Puchas, Ingersheim (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 10/462,706

(22) Filed: Jun. 17, 2003

(65) Prior Publication Data

US 2004/0003784 A1 Jan. 8, 2004

(30) Foreign Application Priority Data

Jun. 29, 2002 (DE) ..... 102 29 365

(51) Int. Cl.[7] ..... F02B 33/04
(52) U.S. Cl. ..... 123/73 R; 123/65 P
(58) Field of Search ..... 123/73 R, 65 P, 123/73 PP, 65 A, 73 A, 73 B, 73 C

(56) References Cited

U.S. PATENT DOCUMENTS 5,027,759 A 7/1991 Luo
5,947,066 A * 9/1999 Ishikawa ..... 123/65 P
6,273,037 B1 8/2001 Cobb, Jr.
6,289,856 B1 * 9/2001 Noguchi ..... 123/73 PP
6,497,204 B1 * 12/2002 Miyazaki et al. ..... 123/73 PP
6,691,649 B2 * 2/2004 Zauner et al. ..... 123/73 B
6,712,029 B1 * 3/2004 Andersson et al. ..... 123/73 R

FOREIGN PATENT DOCUMENTS

| | | |
|---|---|---|
| EP | 0302045 | 2/1989 |
| EP | 0 992 660 | 4/2000 |
| JP | 09250429 | 9/1997 |

* cited by examiner

*Primary Examiner*—Tony M. Argenbright
*Assistant Examiner*—Hyder Ali
(74) *Attorney, Agent, or Firm*—Walter Ottesen

(57) ABSTRACT

A two-stroke engine, especially for a portable handheld work apparatus, includes a combustion chamber configured in a cylinder. The combustion chamber is delimited by a piston which moves upwardly and downwardly. Combustion air is supplied to the engine via an air channel. The air channel opens with an air channel window into the cylinder. The crankcase of the two-stroke engine is connected at pregiven piston positions to the combustion chamber via transfer channels. The transfer channels open with inlet windows into the cylinder. An injection nozzle opens into at least one transfer channel. In the region of top dead center of the piston, the air channel is connected via a piston window to a transfer channel. An injection nozzle is arranged in the transfer channel and injects fuel into the transfer channel during the induction of combustion air into the crankcase.

17 Claims, 4 Drawing Sheets

TWO-STROKE ENGINE AND METHOD OF OPERATING THE SAME

BACKGROUND OF THE INVENTION

European patent publication 0,302,045 discloses a two-stroke engine wherein fuel is injected into the combustion chamber in the region of a transfer channel. The injection starts already ahead of the opening of the transfer channel in order to ensure an adequate supply of fuel also at high engine speeds. The combustion air is supplied to the combustion chamber from the crankcase via the transfer channels. The injected fuel quantity is completely transported into the combustion chamber with the combustion air passing from the crankcase. The crankcase must be separately lubricated.

SUMMARY OF THE INVENTION

It is an object of the invention to provide a two-stroke engine of the kind described above wherein no separate lubrication of the crankcase is needed. Furthermore, a method for operating the two-stroke engine is also provided.

The two-stroke engine of the invention includes a two-stroke engine for a portable handheld work apparatus and the two-stroke engine includes: a crankcase; a cylinder connected to the crankcase; the cylinder having a cylinder wall defining a cylinder bore; a piston displaceably mounted in the cylinder bore and the piston and the cylinder conjointly defining a combustion chamber; a crankshaft rotatably mounted in the crankcase; a connecting rod connecting the piston to the crankshaft so as to permit the piston to drive the crankshaft as the piston reciprocates in the cylinder between bottom dead center and top dead center; the cylinder having a discharge outlet formed therein for conducting exhaust gases away from the combustion chamber; an air channel window formed in the cylinder; an air channel opening into the cylinder at the air channel window and the air channel being provided to supply combustion air; a plurality of transfer channels for connecting the crankcase to the combustion chamber at pregiven positions of the piston and the plurality of transfer channels opening into the cylinder via respective inlet windows in the cylinder; the piston having a piston window formed therein for fluidly connecting the air channel to one of the transfer channels when the piston is in the region of the top dead center; and, an injection nozzle opening into the one transfer channel.

According to the invention, a transfer channel is connected to an air channel via a piston window at top dead center of the piston. An injection nozzle for injecting fuel is mounted in the transfer channel. In the region of top dead center of the piston, the injection nozzle injects fuel into the transfer channel which is supplied to the crankcase by the air flow flowing from the air channel through the transfer channel to the crankcase. The crankcase is lubricated in this way by the fuel. The connection of the air channel and transfer channel via a piston window makes the operation of the two-stroke engine possible with scavenging advance. In this way, the exhaust-gas values are improved.

It can be purposeful that the air channel is fluidly connected to the inlet window of the transfer channel via the piston window at pregiven piston positions. In this way, the transfer channel can be completely filled with combustion air substantially free of fuel so that a good scavenging result is achieved. At the same time, a reduced structural height of the cylinder is provided because no additional control openings are needed along the longitudinal length of the transfer channel. In a transfer channel closed to the cylinder over a portion of its longitudinal length, the inlet window is the opening into the interior of the cylinder in the region of the combustion chamber. For a transfer channel open to the cylinder, the inlet window is the region of the transfer channel which is open to the combustion chamber at bottom dead center of the piston.

It can, however, be purposeful that the transfer channel has a connecting window to the cylinder interior via which the transfer channel is connected to the air channel at pregiven piston positions. The connecting window is mounted especially offset relative to the inlet window of the transfer channel in the direction toward the crankcase. This connecting window is arranged approximately at the elevation of the air channel window. In this way, a short flow path results so that a sufficient supply of combustion air is ensured also at high engine speeds.

The air channel is offset relative to a center plane in the direction toward the transfer channel having the injection nozzle. This center plane partitions the outlet at approximately the center. The flow path in the piston window is further shortened in this manner. At the same time, large flow cross sections can be realized without the structural space for the piston pin and connecting rod being affected. The injection nozzle is mounted offset to the crankcase relative to the inlet window of the transfer channel. In this way, an adequately large air quantity can be stored in advance in the transfer channel even when fuel is continuously injected. Advantageously, the air channel window is mounted offset in the direction toward the crankcase relative to the inlet window of the transfer channel. In order to ensure adequate supply of the two-stroke engine with combustion air also at high engine speeds, it is practical to provide an inlet into the crankcase for the supply of additional combustion air substantially free of fuel. The injected fuel advantageously contains lubricating oil in order to improve lubricating characteristics in the crankcase.

For a method of operating a two-stroke engine, it is provided that at least a component quantity of the combustion air is drawn by suction into the crankcase via a piston window through a transfer channel into which fuel is injected at pregiven control times. Fuel is injected especially during the induction of combustion air into the crankcase. In this way, fuel is supplied to the crankcase which serves there for lubrication. A separate crankcase lubrication is not needed. The induction via a transfer channel makes possible the operation of the two-stroke engine with scavenging advance. In this way, good exhaust-gas values are obtained.

Advantageously, the combustion air, which is needed for the combustion, is drawn by suction completely from the air channel. A separate inlet for the combustion air into the crankcase is therefore not necessary. However, it can be practical that a component quantity of the combustion air is drawn by suction via an inlet into the crankcase. In this way, an adequate supply of the engine with combustion air is ensured especially at high engine speeds.

It is provided that the start and/or end of the injection is adapted in dependence upon load and/or engine speed. Accordingly, for each combustion, the optimal fuel quantity can be made available. In this way, favorable exhaust-gas values result. In order to achieve high power, it is provided that injection is continuous in specific rpm regions, especially in the region of full load.

It is provided that at specific rpm ranges during induction of combustion air from the air channel into the crankcase, at least a first component quantity of the fuel, which is needed for the combustion, is injected into the transfer channel. This fuel arrives directly in the crankcase and contributes to the lubrication of the crankcase in this manner. At specific rpm ranges, at least a second component quantity of the fuel, which is needed for the combustion, is injected into the transfer channel while an air/fuel mixture passes into the combustion chamber from the crankcase via the transfer channel. This injected second component quantity of fuel is thereby transported directly into the combustion chamber and is available for the next combustion.

The pressure of the injected fuel is advantageously higher than the pressure of the combustion air entering into the cylinder from the transfer channel. The pressure of the injected fuel is up to 6 bar above the pressure of the combustion air entering into the cylinder from the transfer channel. The comparatively low difference pressure and the low injection pressure resulting therefrom make possible the use of a simply configured injection nozzle.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
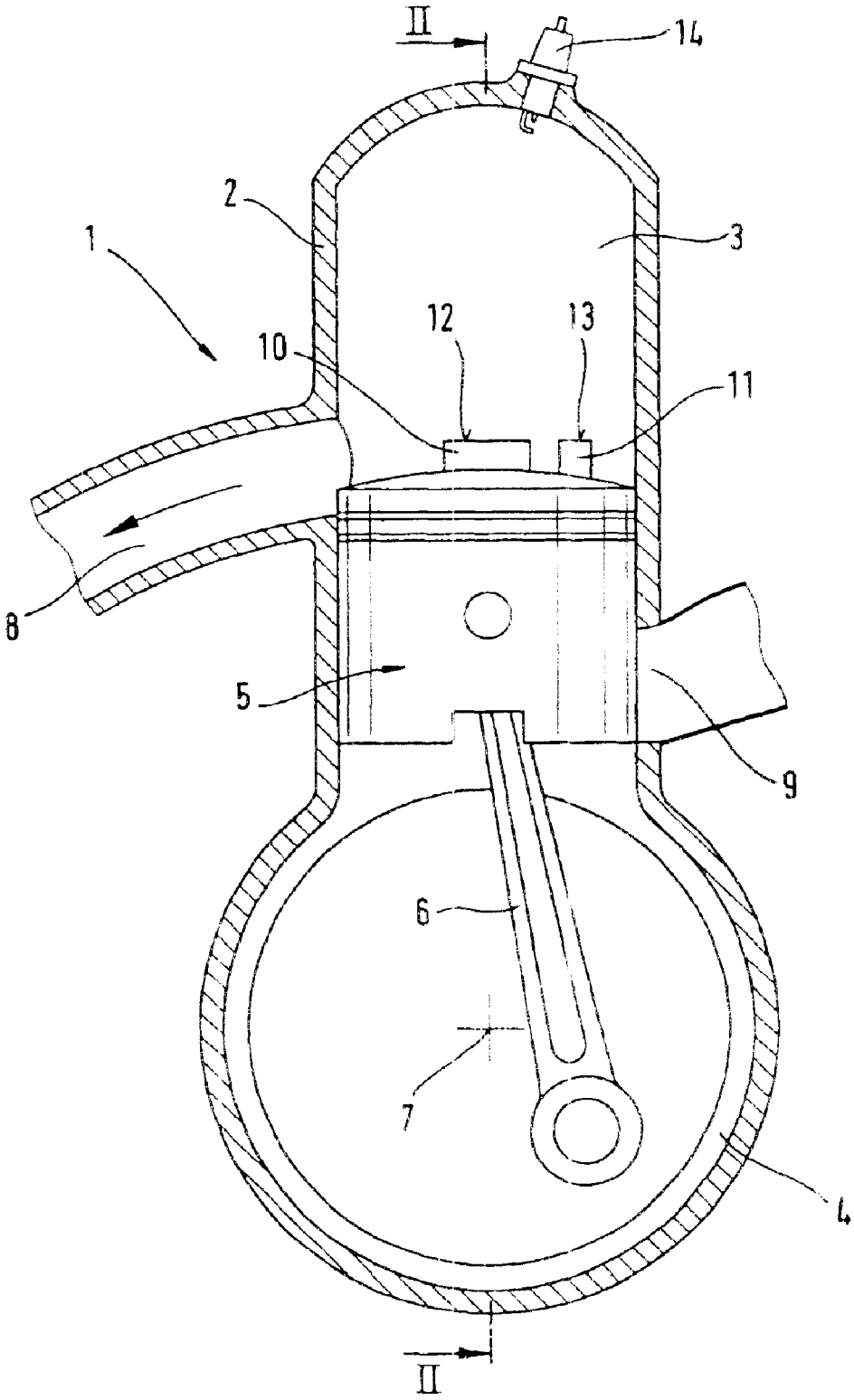
FIG. 1 is a schematic, in longitudinal section, of a two-stroke engine according to the invention.

The two-stroke engine 1 shown in FIG. 1 includes a cylinder 2 and a combustion chamber 3 formed in the cylinder 2. The combustion chamber 3 is delimited by the upwardly and downwardly moving piston 5. The piston 5 drives a crankshaft 7 via a connecting rod 6. The crankshaft 7 is rotatably journalled in the crankcase 4. Crankcase 4 and combustion chamber 3 are fluidly connected to each other at pregiven piston positions via the transfer channels 10 and 11. The outlet-near transfer channel 10 opens with an inlet window 12 into the combustion chamber 3 and the outlet-remote transfer channel 11 opens into the combustion chamber with an inlet window 13. The cylinder 2 includes an outlet 8 for exhaust gases from the combustion chamber 3. An inlet 9 is provided in the crankcase 4 for the supply of additional combustion air. A spark plug 14 is mounted in the combustion chamber 3 and ignites the air/fuel mixture in the region of top dead center of the piston 5.

Figure 2:
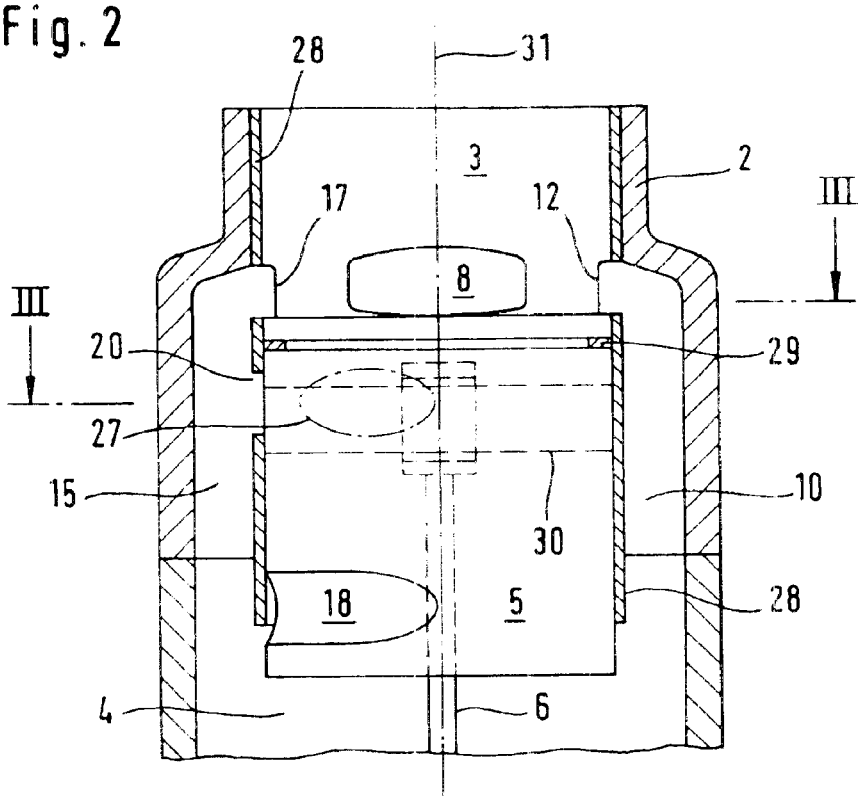
FIG. 2 is a section view through a cylinder of the two-stroke engine of FIG. 1 taken along line II—II.

In FIG. 2, a section of a cylinder 2 is shown corresponding to line II—II of FIG. 1. The piston 5 is shown in FIG. 2 at bottom dead center and includes a piston window 18. A piston ring 29 is mounted on the periphery of the piston 5 on the end of the piston 5 facing toward the combustion chamber 3. An air channel window 27 is arranged in the cylinder 2 and is shown in FIG. 2 by a dot-dash line. In FIG. 2, the air channel window 27 lies ahead of the plane of the drawing. Viewed in the direction of the cylinder longitudinal axis 31, the air channel window 27 is mounted offset relative to the inlet window 17 of the transfer channel 15 in a direction toward the crankcase 4. The piston 5 is fixed on the connecting rod 6 via a piston pin 30 shown by a broken line in FIG. 2.

Figure 3:
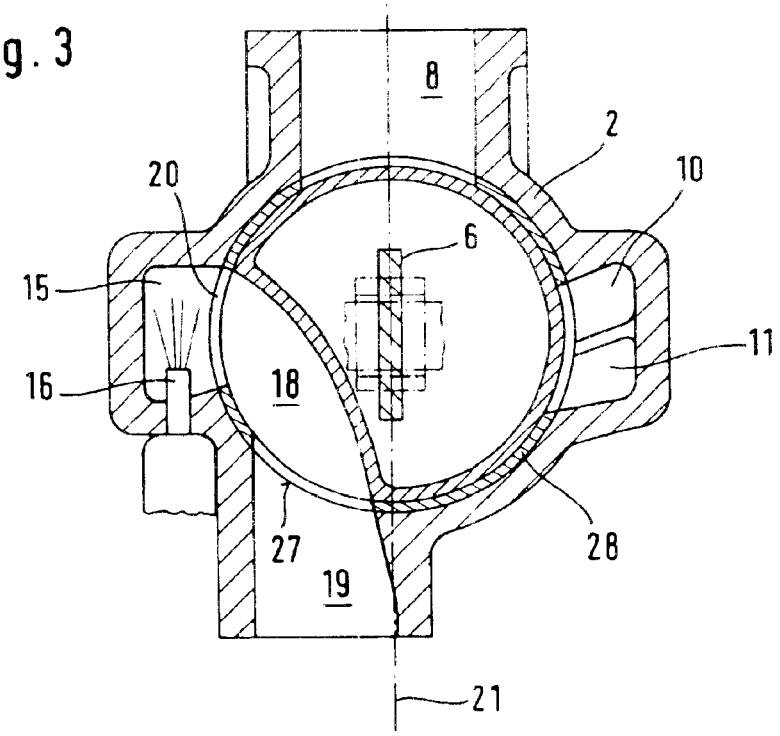
FIG. 3 is a section view taken along line III—III of FIG. 2.

In FIG. 3, the cylinder 2 is shown on a section taken along line III—III of FIG. 2. The air channel window 27 defines an outlet opening of the air channel 19 into the cylinder 2. The cylinder 2 has a center plane 21 which partitions the outlet 8 approximately at the middle. The outlet-near transfer channel 10 and the outlet-remote transfer channel 11 are arranged on one side of the center plane 21. A transfer channel 15 is arranged on the opposite-lying side of the cylinder. The transfer channel 15 opens with an inlet window 17 into the combustion chamber 3. In the peripheral direction, the transfer channel 15 has approximately the spread of the two transfer channels 10 and 11 and likewise defines a fluid connection between the crankcase 4 and the combustion chamber 3 at pregiven piston positions. However, it can also be practical to configure the transfer channel 15 to be partitioned. The partition of the transfer channel can extend over a portion of the longitudinal length of the transfer channel 15.

A connecting window 20 is provided in the sleeve 28 in which the piston 5 runs and this window 20 is approximately at the elevation of the air channel window 27. The connecting window 20 is offset relative to the inlet window 17 of the transfer channel 15 in the direction toward the crankcase 4. The connecting window 20 connects the air channel 19 to the transfer channel 15 via the piston window 18 at top dead center of the piston 5 shown in FIG. 3. An injection nozzle 16 is mounted in the transfer channel 15 approximately at the elevation of the connecting window 20. The injection nozzle injects fuel into the transfer channel 15 at pregiven control times. As shown in FIG. 3, the piston window 18 is configured to be concave in a plane perpendicular to the cylinder longitudinal axis 31. The back wall of the piston window 18 can advantageously run parallel to the cylinder longitudinal axis 31. It is practical that the air channel 19 passes tangentially into the piston window 18. The transition from the piston window 1B via the connecting window 20 into the transfer channel 15 is also purposefully configured to be tangential.

During operation of the two-stroke engine 1, combustion air is drawn by suction into the crankcase 4 via the piston window 18, the connecting window 20 and the transfer channel 15 in the region of top dead center of the piston 5. During the induction, a first component quantity of fuel is injected by the injection nozzle 16 into the transfer channel 15. The fuel with the combustion air reaches the crankcase 4. Additional combustion air can be supplied to the crankcase 4 via an inlet 9 (FIG. 1). In the downward movement of the piston 5, the air/fuel mixture is compressed in the crankcase 4 and is supplied to the combustion chamber 3 via the transfer channels 10, 11 and 15 in the region of bottom dead center. During the transfer of the air/fuel mixture into the combustion chamber 3, a second component quantity of fuel is injected by the injection nozzle 16 into the transfer channel 15. This synchronously injected fuel together with the air/fuel mixture goes directly from the crankcase 4 into the combustion chamber 3.

The injection nozzle 16 is connected to an electronic mixture metering system. The start and end of the injection can thereby be adapted in dependence upon rpm and/or load. The fuel quantity, which is supplied to the combustion chamber 3, is made up of the second component quantity, which is injected synchronously, and a fuel component quantity which was injected in a previous injection cycle and now reaches the combustion chamber 3 from the crankcase 4. Especially at high rpms, the injection nozzle 16 continuously injects fuel into the transfer channel 15. The pressure of the synchronously injected fuel is higher than the pressure of the combustion air entering from the transfer channel 15 into the cylinder 2. Advantageously, the pressure of the injected fuel is 1 to 8 bar higher than the pressure of the combustion air. The fuel injected into the transfer channel 15 can contain lubricating oil in order to provide for an adequate lubrication of the crankcase 4.

As shown in FIG. 3, the air channel 19 is arranged offset in the peripheral direction relative to the center plane 21 in a direction toward the transfer channel 15. It can be practical to supply substantially fuel-free combustion air to the transfer channel 15 as well as to the oppositely-arranged transfer channels 10 and 11. The two air channels then open in the cylinder at symmetrically arranged air channel windows. The piston includes two symmetrically arranged piston windows. It can be practical to inject fuel into several transfer channels. The transfer channels into which the fuel is injected can, for example, be arranged symmetrically to the center plane 21.

Figure 4:
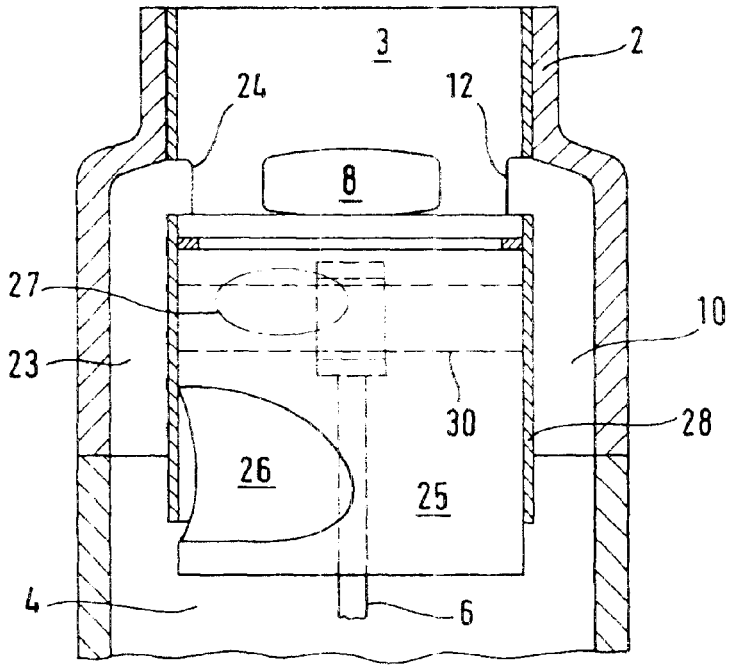
FIG. 4 is a section view through the cylinder of a two-stroke engine taken along line II—II of FIG. 1.
Figure 5:
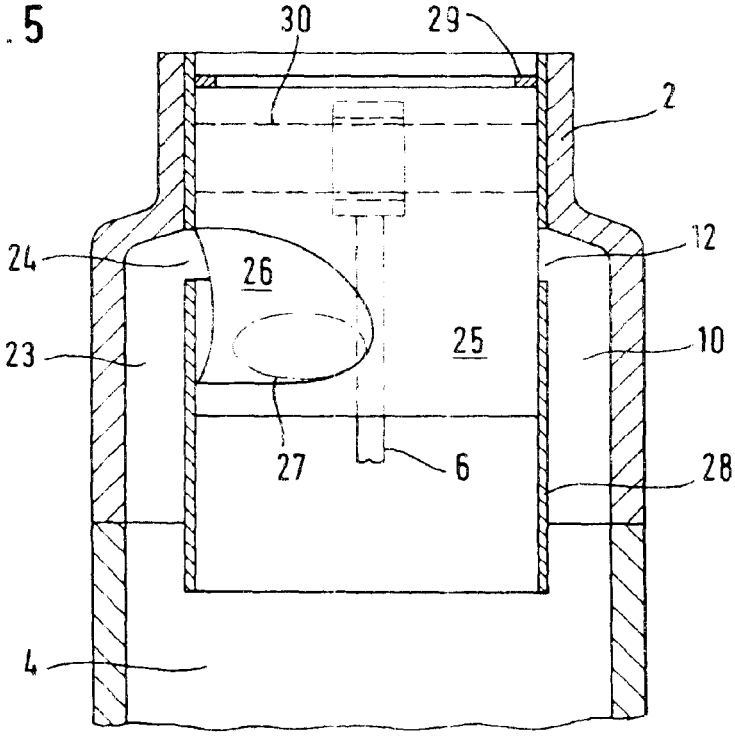
FIG. 5 is a section view of the cylinder of FIG. 4 with the piston at top dead center; and, FIG. 6 is a section view through the cylinder taken along line II—II of FIG. 1.

An embodiment of the invention is shown in FIGS. 4 and 5. In FIG. 4, a piston 25 is shown in a cylinder 2 at bottom dead center; whereas, in FIG. 5, the piston 25 is shown at top dead center. The cylinder 2 includes two transfer channels 10 and 11 corresponding to the cylinder 2 shown in FIGS. 2 and 3 as well as an oppositely-lying transfer channel 23. Fuel is injected by an injection nozzle 16 into the transfer channel 23. The injection nozzle 16 is not shown in FIGS. 4 and 5. The transfer channel 23 opens with an inlet window 24 into the combustion chamber 3 of the cylinder 2. The piston 25 includes a piston window 26 which connects the air channel 19 to the inlet window 24 of the transfer channel 23 at top dead center of the piston 25 shown in FIG. 5. The air channel 19 opens with an air channel window 27 into the cylinder 2. The air channel window 27 is shown by a dash-dot line in FIGS. 4 and 5 and lies ahead of the plane of the drawing. The transfer channel 23 is scavenged completely with substantially fuel-free combustion air from the air channel 19. The injection nozzle 16 is arranged below the inlet window 24 especially approximately at the elevation of the air channel window 27. However, it can be practical to arrange the injection nozzle 16 at the elevation of the inlet window 24.

For operating the two-stroke engine, combustion air is inducted in the region of top dead center of piston 25 from the air channel 19 into the crankcase 4 via the air channel window 27, the piston window 26, the inlet window 24 and the transfer channel 23. During the induction, fuel is injected into the transfer channel 23 which reaches the crankcase 4 together with the combustion air and there serves to lubricate. The injection of fuel ends while combustion air still flows from the air channel 19 into the transfer channel 23 so that the transfer channel 23 is completely filled with substantially fuel-free air. With the arrangement of the injection nozzle 16 below the inlet window 24, an adequate air advance storage is achieved, however, also during continuous fuel injection. The term "below" here means offset in a direction toward the crankcase 4. With the downward movement of the piston 25, the air/fuel mixture is compressed in the crankcase 4 and is conducted via the inlet windows 24, 12 and 13 of the transfer channels into the combustion chamber 3 in the region of bottom dead center of the piston 25. In the following upward movement of the piston 25, the mixture is compressed and is ignited in the region of top dead center by the spark plug 14. The exhaust gases are conducted away from the combustion chamber 3 through the outlet 8. The injection time point of fuel is advantageously varied in dependence upon rpm and/or load. Advantageously, and especially in the lower rpm ranges, two separate injections take place for each crankshaft revolution while, at high rpms, fuel is injected continuously.

Figure 6:
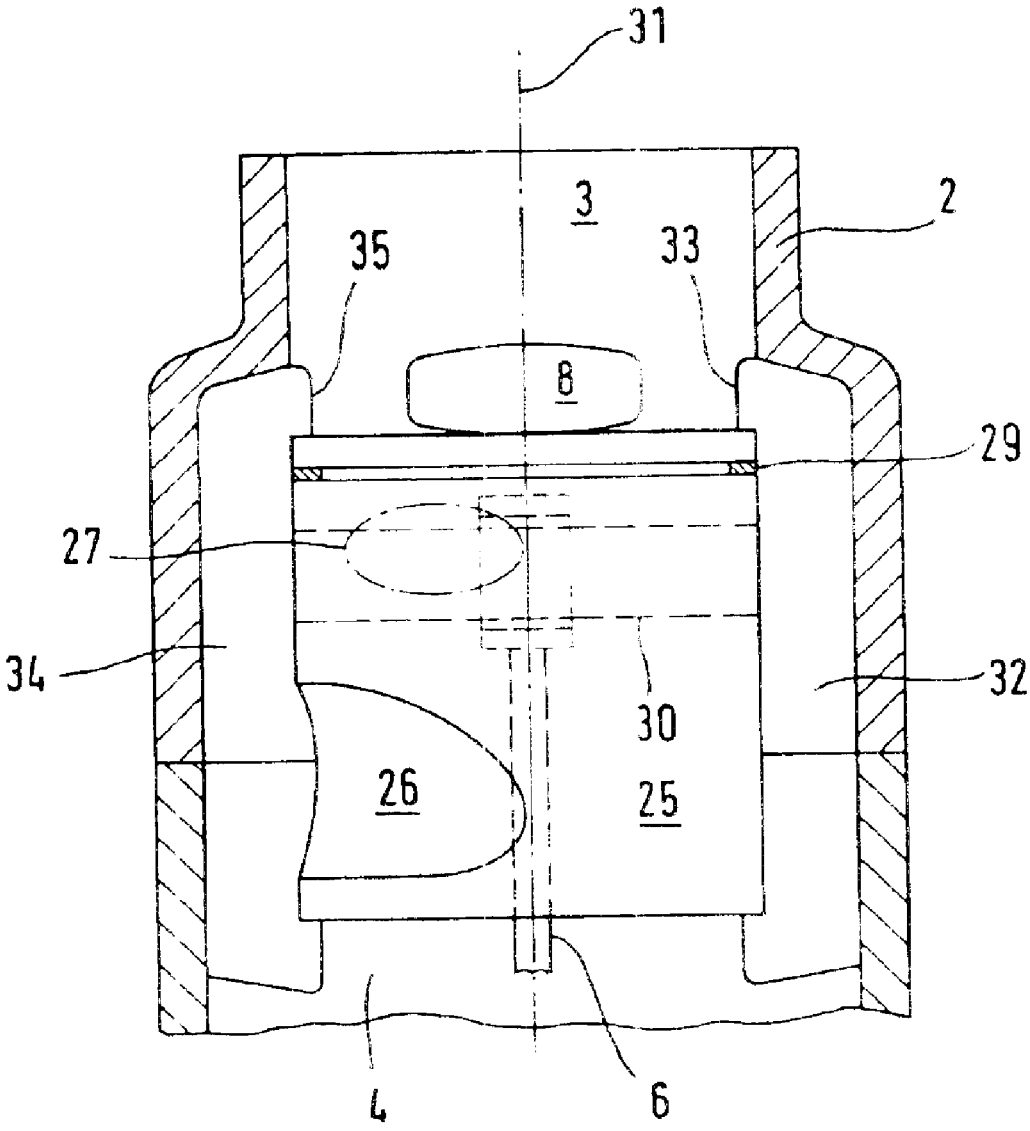

In FIG. 6, a further embodiment of a cylinder 2 is shown. The cylinder 2 includes a transfer channel 32 which opens with an inlet window 33 into the combustion chamber 3 as well as a transfer channel 34 which has an inlet window 35 into the combustion chamber 3. The transfer channels (32, 34) are open to the cylinder interior over their entire longitudinal extent, that is, over their extent in the direction of the cylinder longitudinal axis 31. The inlet windows (33, 35) are the respective regions of the transfer channels (32, 34) which are fluidly connected to the combustion chamber in the region of bottom dead center of the piston 25. The piston window 26 is arranged in piston 25 and is open toward the transfer channel 34 in each position of the piston 25. At positions of the piston 25 at which the piston window 26 is disposed in the region of the air channel window 27, the piston window 26 defines a fluid connection from the air channel 19 (not shown in FIG. 6) into the transfer channel 34. Advantageously, the connection is established via the inlet window 35 in the region of top dead center of the piston 25. However, it can also be practical that the piston window 26 is offset relative to the inlet window 35 in the direction toward the crankcase at top dead center of the piston 25. An injection nozzle 16 is arranged in the transfer channel 34 corresponding to FIG. 3. Fuel can be injected into the combustion air coming into the transfer channel 34 via the piston window 26 in the region of top dead center of the piston and this fuel, together with the combustion air, is supplied to the crankcase 4.

It is understood that the foregoing description is that of the preferred embodiments of the invention and that various changes and modifications may be made thereto without departing from the spirit and scope of the invention as defined in the appended claims.

What is claimed is:

1. A two-stroke engine including a two-stroke engine for a portable handheld work apparatus, the two-stroke engine comprising:

a crankcase;

a cylinder connected to said crankcase;

said cylinder having a cylinder wall defining a cylinder bore;

a piston displaceably mounted in said cylinder bore and said piston and said cylinder conjointly defining a combustion chamber;

a crankshaft rotatably mounted in said crankcase;

a connecting rod connecting said piston to said crankshaft so as to permit said piston to drive said crankshaft as said piston reciprocates in said cylinder between bottom dead center and top dead center;

said cylinder having a discharge outlet formed therein for conducting exhaust gases away from said combustion chamber;

an air channel window formed in said cylinder;

an air channel opening into said cylinder at said air channel window and said air channel being provided to supply combustion air;

a plurality of transfer channels for connecting said crankcase to said combustion chamber at pregiven positions of said piston and said plurality of transfer channels opening into said cylinder via respective inlet windows in said cylinder;

said piston having a piston window formed therein for fluidly connecting said air channel to one of said transfer channels when said piston is in the region of said top dead center;

an injection nozzle opening into said one transfer channel; and, said one transfer channel having a connecting window to the interior of said cylinder via which said one transfer channel is connected to said air channel at pregiven positions of said piston.

2. The two-stroke engine of claim 1, wherein said connecting window is arranged so as to be offset relative to said inlet window of said one transfer channel in a direction toward said crankcase.

3. The two-stroke engine of claim 2, wherein said connecting window is arranged approximately at the elevation of said air channel window.

4. The two-stroke engine of claim 1, wherein said air channel is offset relative to a partition plane approximately centrally dividing said discharge outlet with said offset being in the peripheral direction of said cylinder in a direction toward said one transfer channel into which said injection nozzle opens.

5. The two-stroke engine of claim 1, wherein said injection nozzle is disposed offset relative to said inlet window of said one transfer channel in a direction toward said crankcase.

6. The two-stroke engine of claim 1, wherein said air channel window is disposed offset relative to said inlet window of said one transfer channel in a direction toward said crankcase.

7. The two-stroke engine of claim 1, further comprising an inlet in said crankcase for supplying additional combustion air.

8. A two-stroke engine including a two-stroke engine for a portable handheld work apparatus, the two-stroke engine comprising:

a crankcase;

a cylinder connected to said crankcase;

said cylinder having a cylinder wall defining a cylinder bore;

a piston displaceably mounted in said cylinder bore and said piston and said cylinder conjointly defining a combustion chamber;

a crankshaft rotatably mounted in said crankcase;

a connecting rod connecting said piston to said crankshaft so as to permit said piston to drive said crankshaft as said piston reciprocates in said cylinder between bottom dead center and top dead center;

said cylinder having a discharge outlet formed therein for conducting exhaust gases away from said combustion chamber;

an air channel window formed in said cylinder;

an air channel opening into said cylinder at said air channel window and said air channel being provided to supply combustion air;

a plurality of transfer channels for connecting said crankcase to said combustion chamber at pregiven positions of said piston and said plurality of transfer channels opening into said cylinder via respective inlet windows in said cylinder; said piston having a piston window formed therein for fluidly connecting said air channel to one of said transfer channels when said piston is in the region of said top dead center;

an injection nozzle opening into said one transfer channel; and, the injected fuel containing lubricating oil.

9. A method for operating a two-stroke engine including a two-stroke engine for a portable handheld work apparatus, the two-stroke engine including: a crankcase; a cylinder connected to said crankcase; said cylinder having a cylinder wall defining a cylinder bore; a piston displaceably mounted in said cylinder bore and said piston and said cylinder conjointly defining a combustion chamber; a crankshaft rotatably mounted in said crankcase; a connecting rod connecting said piston to said crankshaft so as to permit said piston to drive said crankshaft as said piston reciprocates in said cylinder between bottom dead center and top dead center; said cylinder having a discharge outlet formed therein for conducting exhaust gases away from said combustion chamber; at least three transfer channels for connecting said crankcase to said combustion chamber at pregiven control times; and, an air channel for supplying combustion air; the method comprising the steps of:

providing said piston with a piston window;

injecting fuel into at least one of said transfer channels at pregiven control times;

drawing at least a component quantity of said combustion air by suction through said piston window and said one transfer channel into said crankcase; and, wherein the start and/or end of the injection of fuel is adapted in dependence upon at least one of load and rpm.

10. The method of claim 9, wherein the combustion air needed for combustion is drawn completely from said air channel.

11. The method of claim 10, wherein said two-stroke engine further includes an inlet in said crankcase for supplying combustion air; and, a component quantity of said combustion air is drawn by suction into said crankcase via said inlet.

12. The method of claim 9, wherein injection takes place continuously in specific ranges of said rpm.

13. The method of claim 9, wherein said injection takes place continuously at full load.

14. The method of claim 9, wherein at least a first component quantity of the fuel needed for the combustion is injected into said one transfer channel at specific rpm ranges during induction of the combustion air from said air channel.

15. The method of claim 14, wherein, in specific rpm ranges, at least a second component quantity of the fuel needed for the combustion is injected into said one transfer channel in synchronism with an air/fuel mixture coming from said crankcase.

16. The method of claim 9, wherein the pressure of the injected fuel is greater than the pressure of the combustion air entering into said cylinder from said one transfer channel.

17. The method of claim 16, wherein the pressure of the injected fuel is greater by 1 to 8 bar than the pressure of the combustion air entering said cylinder from said one transfer channel.

* * * * *